United States Patent [19]

Pienta

[11] Patent Number: 4,736,567

[45] Date of Patent: Apr. 12, 1988

[54] WRAPPING MACHINE

[75] Inventor: David J. Pienta, Temperance, Mich.

[73] Assignee: Automatic Handling, Inc., Erie, Mich.

[21] Appl. No.: 20,377

[22] Filed: Mar. 2, 1987

[51] Int. Cl.[4] ..... B65B 11/04

[52] U.S. Cl. ..... 53/137; 53/587; 53/176; 53/214; 156/447; 156/519

[58] Field of Search ..... 53/211, 214, 587, 172, 53/176, 137; 156/447, 519

[56] References Cited

U.S. PATENT DOCUMENTS

| | | | |
|---|---|---|---|
| 2,043,830 | 6/1936 | Grant et al. | 53/172 |
| 3,678,646 | 7/1972 | Clark | 53/214 X |
| 3,863,425 | 2/1975 | Edwards | 53/211 X |
| 4,450,668 | 5/1984 | Grossi | 53/211 X |
| 4,553,372 | 11/1985 | Back | 53/211 X |
| 4,565,051 | 1/1986 | Back | 53/211 X |
| 4,598,534 | 7/1986 | Rosenthal | 53/211 X |

FOREIGN PATENT DOCUMENTS

| | | | |
|---|---|---|---|
| 2653730 | 6/1978 | Fed. Rep. of Germany | 53/211 |
| 3412740 | 10/1985 | Fed. Rep. of Germany | 53/211 |

*Primary Examiner*—John Sipos

*Attorney, Agent, or Firm*—Emch, Schaffer, Schaub & Porcello Co.

[57] ABSTRACT

A wrapping machine for wrapping a roll is disclosed. The wrapping machine includes a conveyor for receiving the roll to be wrapped. Support rollers space the roll relative to the conveyor and a drive roller rotates the roll. An upper hold-down assembly supports the upper portion of the roll. A reciprocating carriage is mounted adjacent the conveyor. The carriage delivers wrapping materials which are placed in layers on the roll as it rotates.

17 Claims, 10 Drawing Sheets

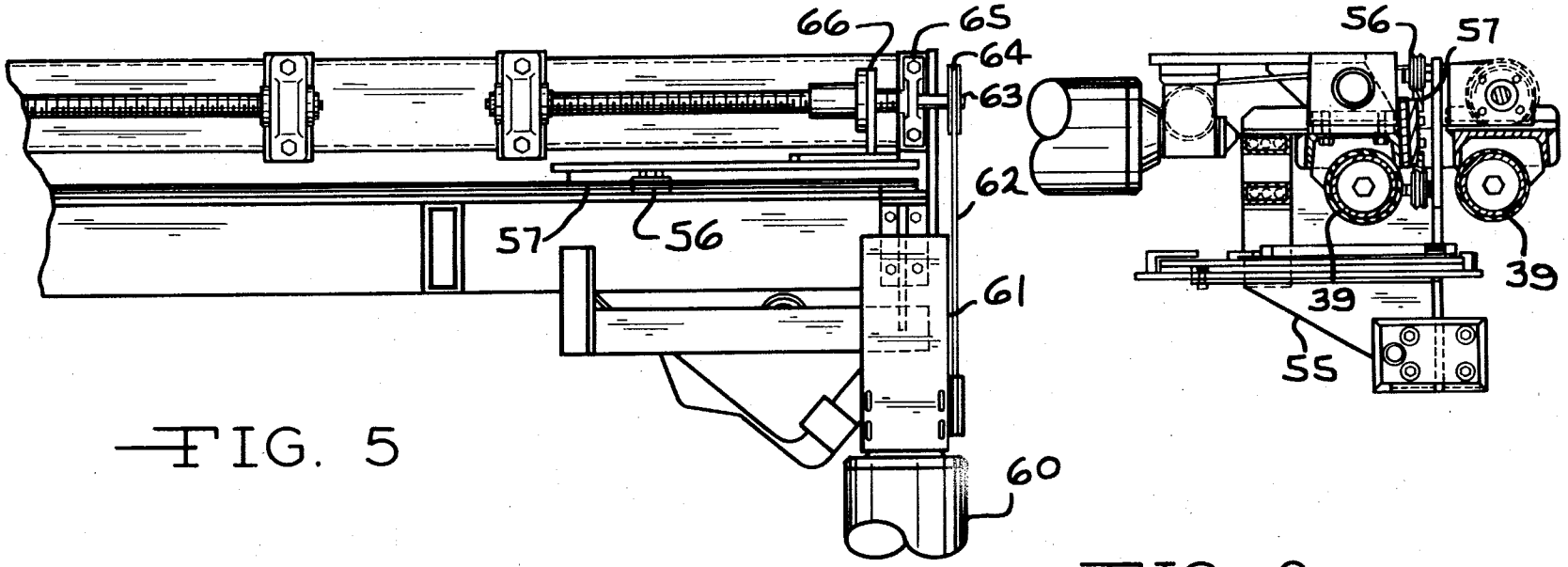
FIG. 5
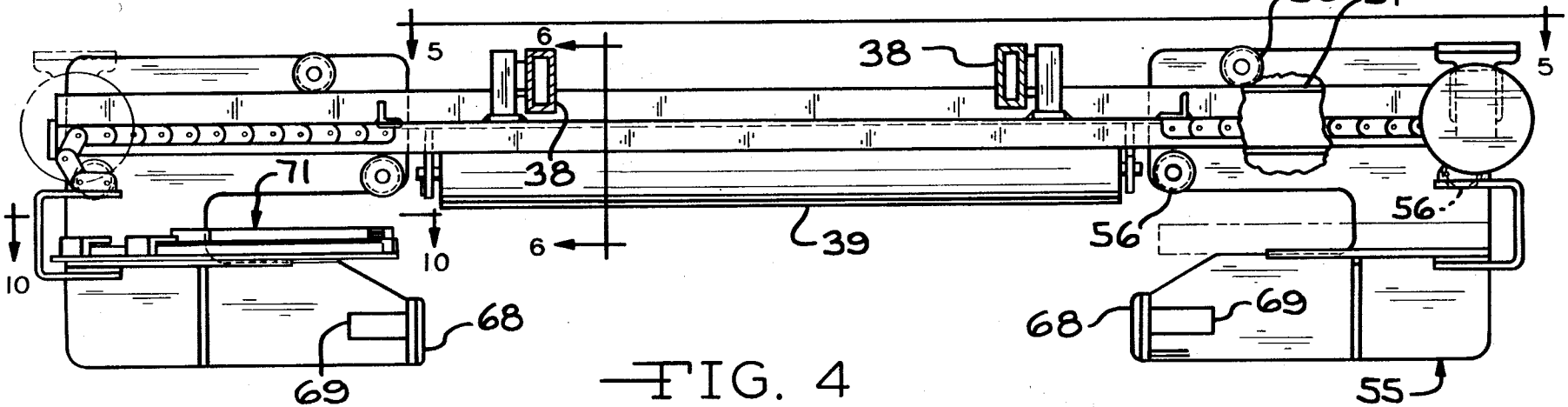
FIG. 6
FIG. 4

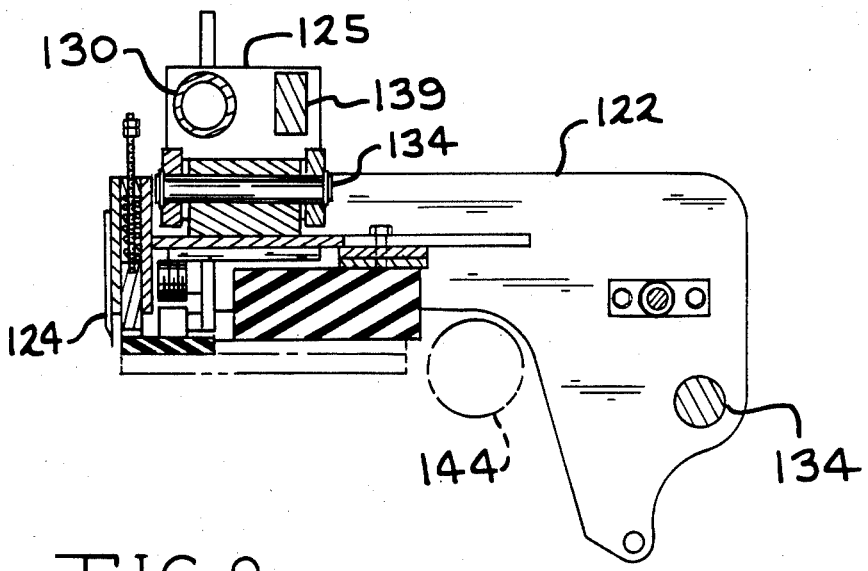
FIG. 9
FIG. 10
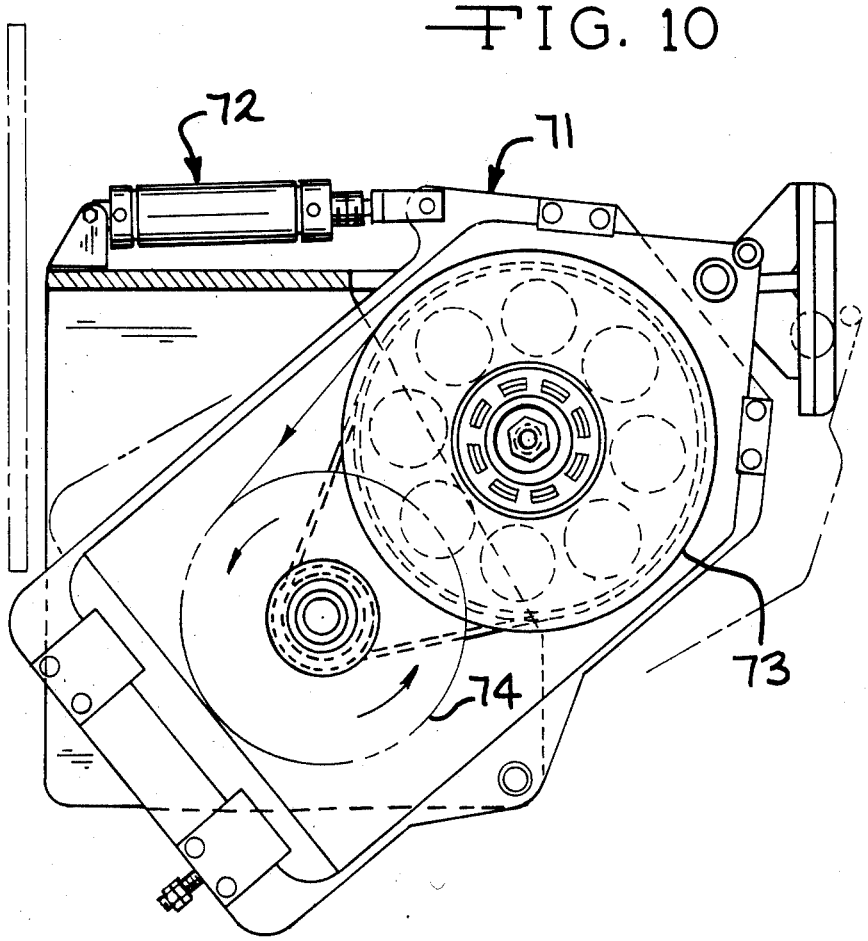

WRAPPING MACHINE

BACKGROUND OF THE INVENTION

A wrapping machine is used to wrap various items. The wrapping machine according to the present invention is specifically designed to wrap a roll. While various types of rolls may be wrapped, the present machine is particularly useful in wrapping paper rolls.

In situations where, for example, carbonless paper comprises the paper roll, multiple layers of wrapping are placed on the outer periphery. In addition, it is preferable if more than one type of wrapping material is utilized. For example, a foam protective wrap layer is used together with a more impervious plastic film type of wrap layer.

The wrapping machine must have the capability of determining the size of the roll, both the height and diameter of the roll. This information is necessary in order to provide the proper lengths of wrap material to ensure the desired number of layers. In addition, if the height of the roll is extensive, means must be provided for the wrapping machine to traverse the length of the roll to ensure that the entire roll is wrapped.

The wrapping machine, according to the present invention, has as its primary object to provide for the efficient, automatic, and proper wrapping of a roll.

SUMMARY OF THE INVENTION

The wrapping machine, according to the present invention, is suitable for wrapping a roll, for example, for wrapping a paper roll. A conveyor is provided to receive the roll which is to be wrapped. Support and drive means space the roll from the conveyor and rotate the roll about its axis of revolution.

A hold-down means, for example, a pair of parallel hold-down rollers support the upper portion of the roll to be wrapped.

The wrapping machine includes a carriage positioned adjacent the roll for supporting at least one supply of wrap material. The carriage is reciprocal along a path parallel to the axis of rotation of the roll which is being wrapped. Supply means are provided on the carriage for delivering the proper amount of wrap material to the roll.

After the roll is wrapped, it is removed from the conveyor and the machine is ready for the next operation.

DESCRIPTION OF THE DRAWINGS

FIG. 4 is an enlarged sectional view taken along the line 4—4 of FIG. 1;

FIG. 5 is a fragmentary plan view taken along the line 5—5 of FIG. 4;

FIG. 6 is a fragmentary cross-sectional view taken along the line 6—6 of Fig. 4;

FIG. 9 is a cross-sectional view taken along the line 9—9 of FIG. 8;

FIG. 10 is an enlarged sectional view of a tape head assembly taken along the line 10—10 of FIG. 4;

DESCRIPTION OF THE PREFERRED EMBODIMENT

Figure 1:
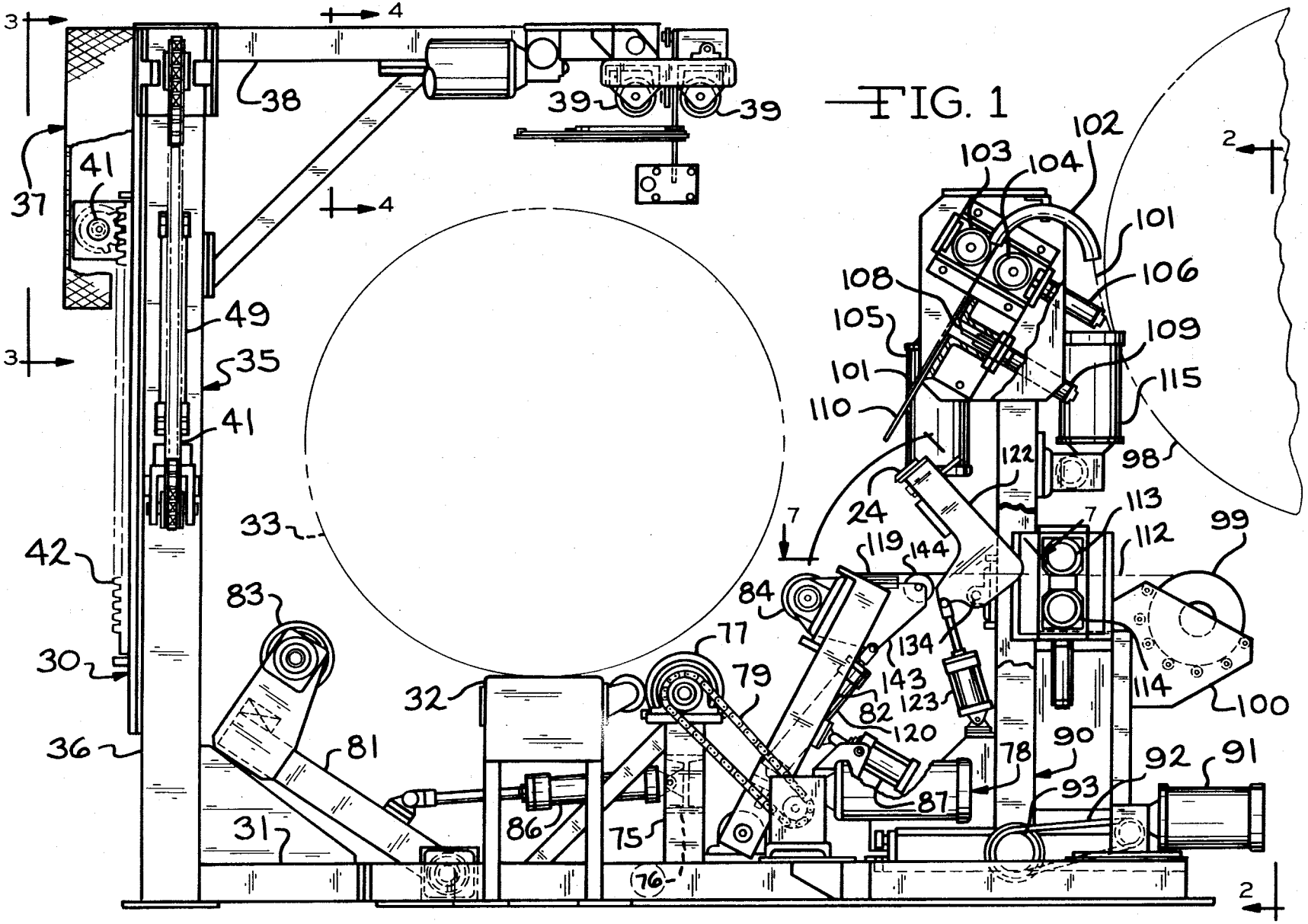
FIG. 1 is an elevational view of a wrapping machine, according to the present invention, and showing only a portion of the foam wrap material feed roll.
Figure 3:
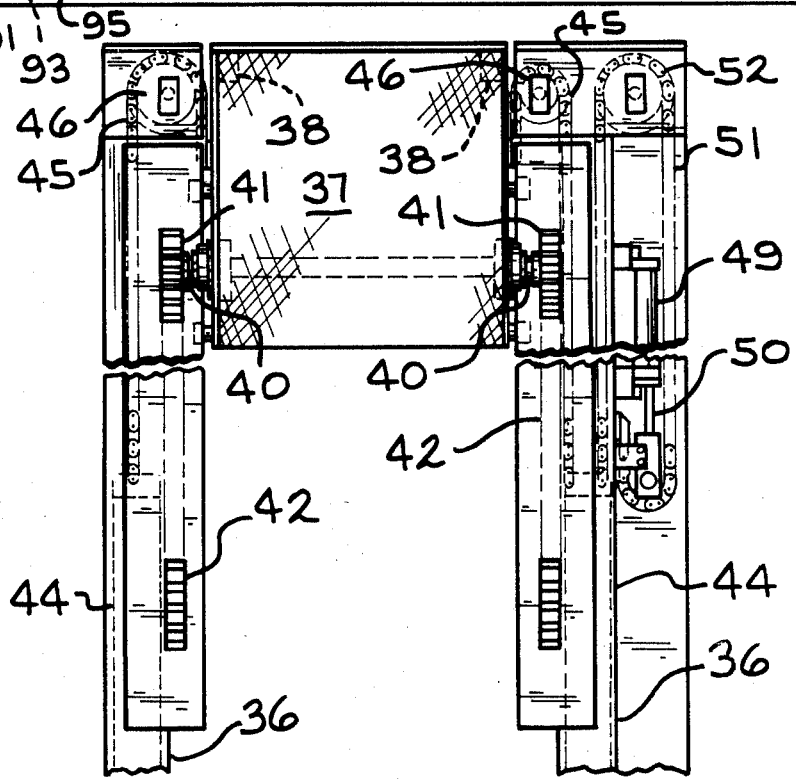
FIG. 3 is a fragmentary elevational view taken along the line 3—3 of FIG. 1.
Figure 11:
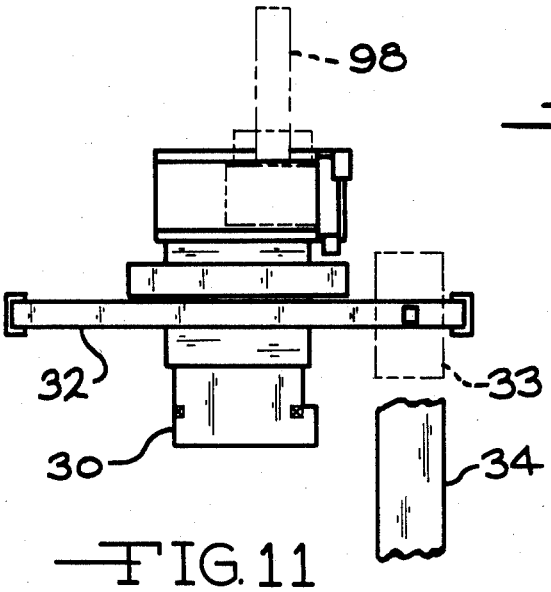
FIG. 11 is a diagramatic plan view of the wrapping machine, according to the present invention.
Figure 12:
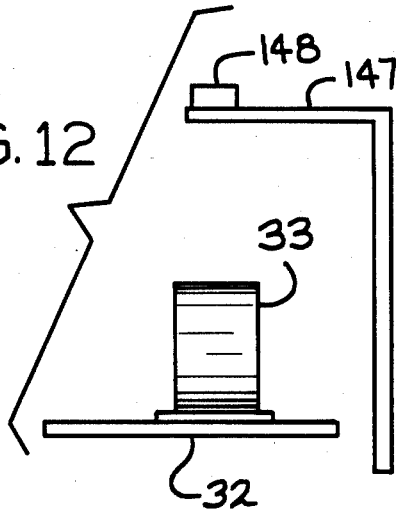
FIG. 12 is a diagramatic view of the wrapping machine shown in FIG. 11 and showing in particular a sensing station.
Figure 20:
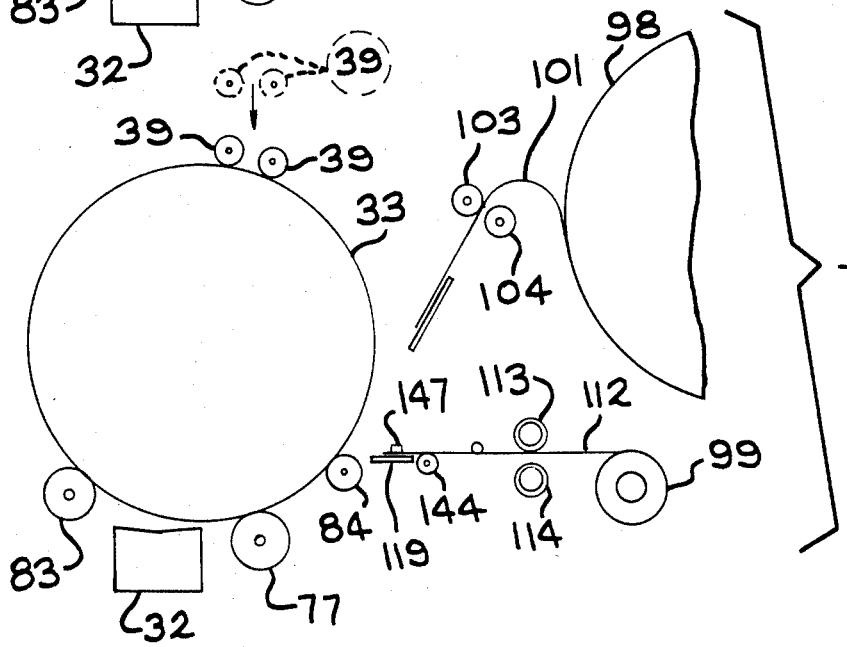
FIG. 20 is a view similar to FIG. 19 showing the hold-down mechanism in position adjacent the upper portion of the paper roll.

A wrapping machine according to the present invention is generally indicated by the reference number 30. Referring to FIG. 1, the wrapping machine 30 includes a base frame 31 and a conveyor 32 positioned above the base frame 31. Referring to FIG. 11, a roll, for example, a paper roll 33 is delivered to the conveyor 32 by a feed conveyor 34 or by some other means such as an overhead crane; a forklift; or manually. A hold-down means 35 is positioned on one side of the wrapping machine 30 and includes a pair of vertical frame members 36 which extend upwardly from the base frame 31. Referring to FIG. 3, a top frame assembly 37 is mounted between the vertical frame members 36 and mounts a pair of outwardly extending support tubes 38. A pair of hold-down rollers 39 are positioned adjacent the outer ends of the support tubes 38. As shown in FIG. 20, the hold-down rollers 39 are moved vertically into a hold-down position against the upper portion of the paper roll 33. This retards vibration of the paper roll 33 during rotation.

The hold-down rollers 39 are moved by moving the top frame assembly 37 relative to the vertical frame members 36. Referring to FIG. 3, jack shafts 40 extend outwardly from the top frame assembly 37 and mount gears 41. The gears 41 engage respective racks 42 which are mounted adjacent the vertical frame members 36. The gears 41 and cooperating vertical racks 42 ensure correct vertical movement of the top frame assembly 37 and the hold-down rollers 39. Counterbalance weights 44 are connected by chains 45 around pulleys 46 adjacent the upper end of the vertically movable top frame assembly 37. A drive cylinder 49 having a rod 50 is operatively connected to the top frame assembly 37 by a drive chain 51 which passes over a pulley 52 and is connected to one of the weights 44. Extension and retraction of the rod 50 of the drive cylinder 49 moves the top frame assembly 37 and the hold-down rollers 39 upwardly and downwardly while the racks 42 and the engaged gears 41 maintain correct vertical alignment.

Referring to FIGS. 4, 5 and 6, the horizontal support tubes 38 of the top frame assembly 37, in addition to mounting the hold-down rollers 39, also mount end assemblies 55. The end assemblies 55 are mounted between the hold-down rollers 39 and are supported by rollers 56 which travel along a V-shaped plate 57 operatively connected to the support tubes 38. A drive motor 60 having a gear box 61 and an output belt 62 drives a shaft 63 which mounts a pulley 64. The shaft 63 extends through a fixed block 65 and has a threaded portion which is operatively connected by a driven ball nut assembly 66 with a respective one of the movable end assemblies 55 and 56.

Each of the end assemblies 55 and 56 mounts a pad 68 and a sensor unit 69. The end assemblies 55 are moved toward one another until the sensors 69 sense the height or length of the individual paper roll 33 which is to be wrapped. This information is then sent to the control unit which determines the width of wrap and the reciprocating movement of the carriage unit.

Figure 26:
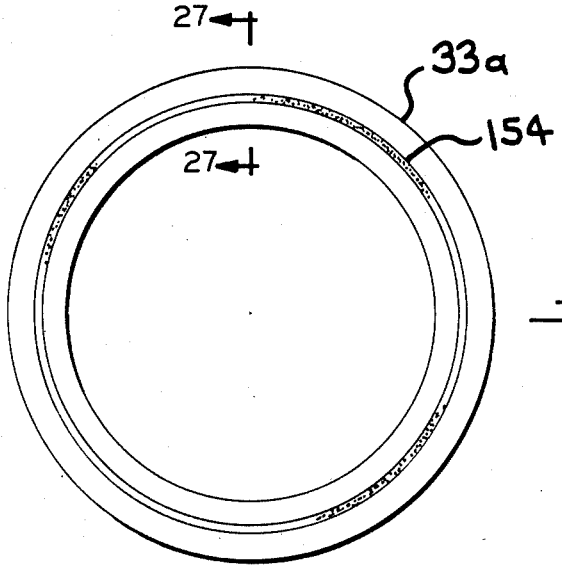
FIG. 26 is an end view of a paper roll showing an adhesive tape layer which has been applied by the upper tape heads.

Each of the movable end assemblies 55 also carries a tape head assembly 71 as shown in detail in FIG. 10. (The right hand tape assembly 71 has been omitted in FIG. 4 for purposes of clarity.) The tape head assembly 71 applies an adhesive layer to the completed side edges of certain ones of rolls being wrapped as indicated in FIG. 26. This type of adhesive layer is often used when intervening partitions or protective disks 155 are placed on the ends of wrapped rolls. Referring to FIG. 10, the tape head assembly 71 includes a cylinder 72 for moving the tape into position against the paper roll 33. The tape head assembly also includes a supply roll 73 for two-sided tape and a waste paper roll 74, which receives the paper layer located between the layers of two-sided tape.

Figure 2:
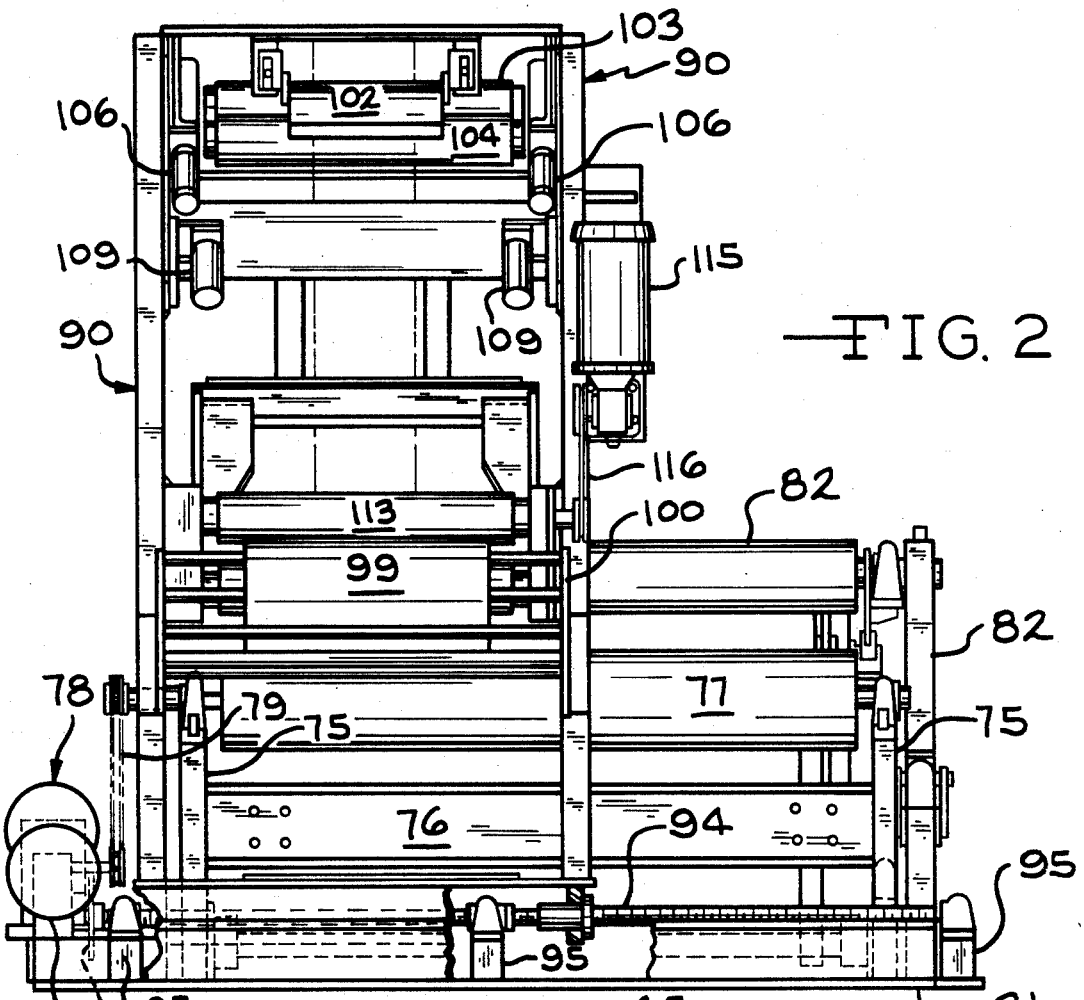
FIG. 2 is an elevational view taken along the line 2—2 of FIG. 1.

Referring to FIGS. 1 and 2, the base frame 31 includes vertical side frame members 75 connected together by an intermediate I-beam 76. A driven support roller 77 is supported by the vertical side frame members 75 and is driven by a motor and gearbox assembly 78 shown in FIGS. 1 and 2. A drive chain 79 extends between the motor and gearbox assembly 78 and the driven support roller 77.

Pairs of pivoting support arms 81 and 82 mount support rollers 83 and 84, respectively. The support roller 83 is moved in and out of position relative to the paper roll 33 by cylinders 86 which are connected between the pivoting arm 81 and the I-beam 76. Similarly, the support roller 84 is pivoted toward and away from the paper roll 33 by the activation of telescoping cylinders 87 which are operatively connected to the pivoting arm 82 which mounts the support roller 84.

Referring to FIGS. 1 and 2, a carriage 90, having a generally rectangular configuration, is mounted for movement on the base frame 31. A motor and gearbox assembly 91 has an output drive chain 92 which drives a sprocket 93 mounted on the end of a threaded drive shaft 94 (see FIG. 2). Bearing supports 95 extend upwardly from the base frame 31 and rotatably mount the threaded shaft 94. The shaft 94 is mounted parallel to the longitudinal axis of rotation of the paper roll 33. The carriage 90 is mounted for movement on the threaded shaft 94. When wide paper rolls **33*a* are being wrapped, the carriage 90 is reciprocated back and forth along the shaft 94 so that the entire paper roll 33*a* may be wrapped. This is shown diagramatically in FIG. 25**.

In the present embodiment, two types of wrapping materials are utilized and wrapped around the periphery of the paper roll 33. However, the machine 30 is capable of utilizing different types of wrapping material and different numbers of layer arrangements.

In the present embodiment, a roll of foamed plastic, indicated by the reference number 98, is mounted for rotation on a shaft (not shown) adjacent the carriage 90. A roll of plastic stretch wrap wrapping material, generally indicated by the reference number 99, is mounted in a container 100 which is supported by the carriage 90.

Referring to FIGS. 1 and 2, as a foam wrapping material layer 101 is discharged from the foam roll 98, it enters a guide chute 102 and passes between foam feed and tension rollers 103 and 104. A motor and gearbox assembly 105 are operatively connected to the foam roller 103 to drive the roller. The foam roller 104 is movably mounted and cylinders 106 move the foam roller 104 inwardly and outwardly between the position shown in FIG. 1 and a drive position where the rollers 103 and 104 are in engaging relationship with the foam wrapping material layer 101.

A cutter knife 108 is mounted below the foam rollers 103 and 104 and is moved against the foam wrapping material layer 101 by cutting knife cylinders 109. Guide members 110 are positioned below the location of the cutter knife 108 to guide the foam material layer 101 toward the paper roll 33.

Referring to FIGS. 1 and 2, a plastic film layer 112 is removed from the film roll 99 and passes between an upper film roller 113 and a lower film roller 114. The upper film roller 113 is driven by a motor and gearbox assembly 115 which is connected to the roller 113 by a drive chain 116.

Figure 21:
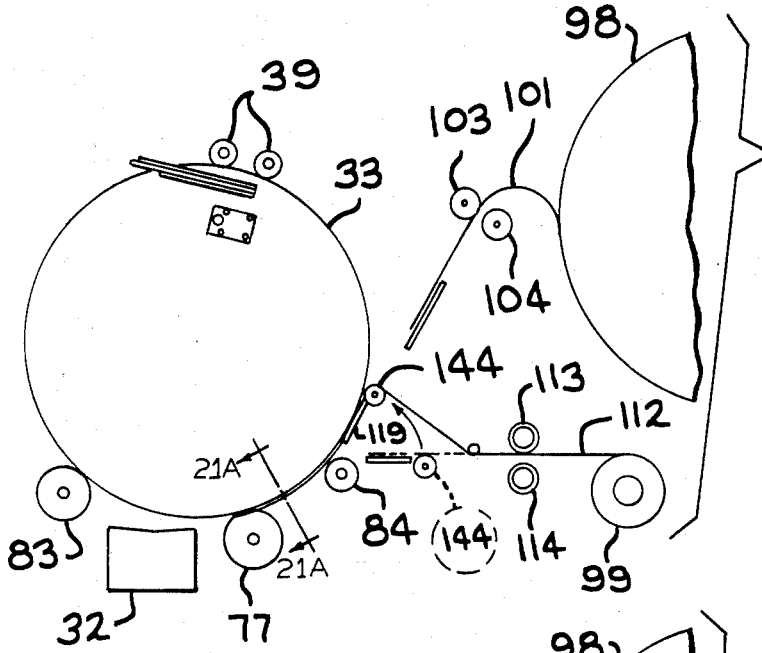
FIG. 21 shows the paper roll as the first layer of plastic film is adhered to its periphery.
Figure 21A:
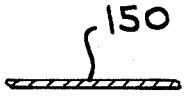
FIG. 21(A) shows a cross-section of the paper layer.

Referring to FIG. 1, a pivotable vacuum table 119 is mounted adjacent the paper roll 33 and provides a path for the plastic film layer 112. The cylinders 87 and cylinders 120 pivot the vacuum table 119 between the horizontal position shown in FIG. 1 and a position adjacent the periphery of the paper roll 33 as indicated in FIG. 21.

Figure 7:
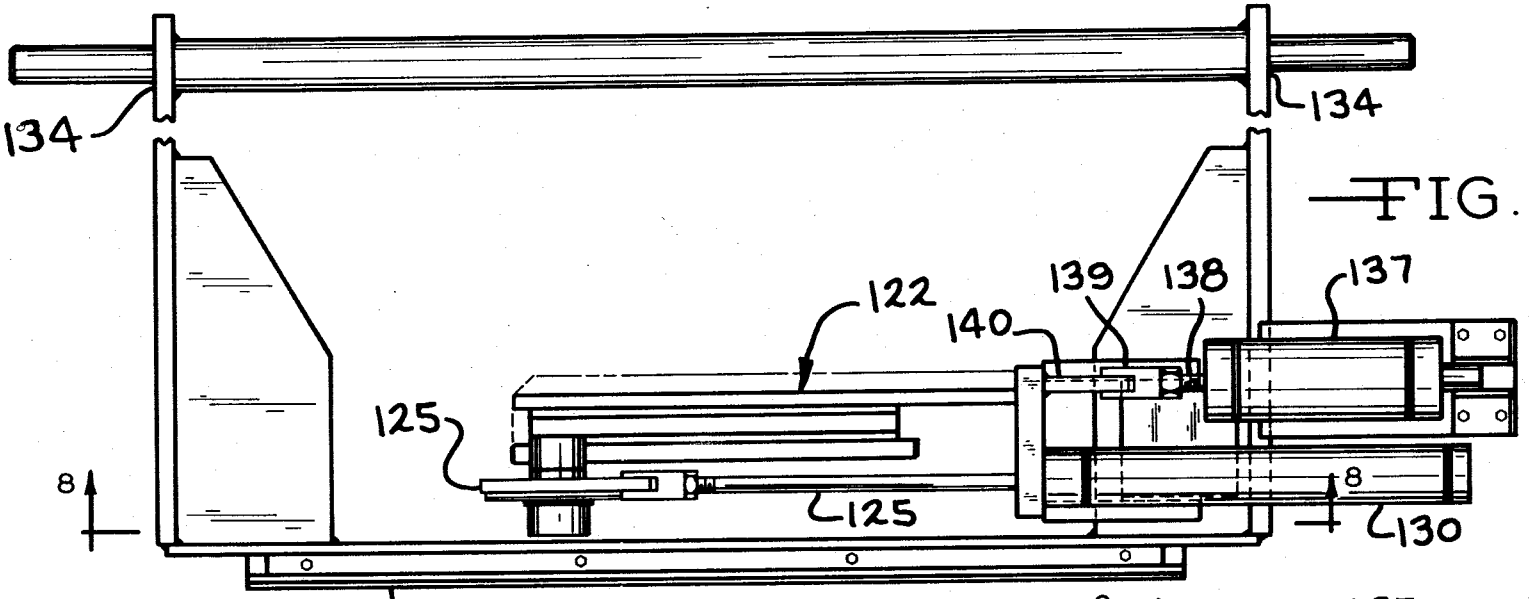
FIG. 7 is a fragmentary plan view taken along the line 7—7 of FIG. 1 and shown on an enlarged scale.
Figure 8:
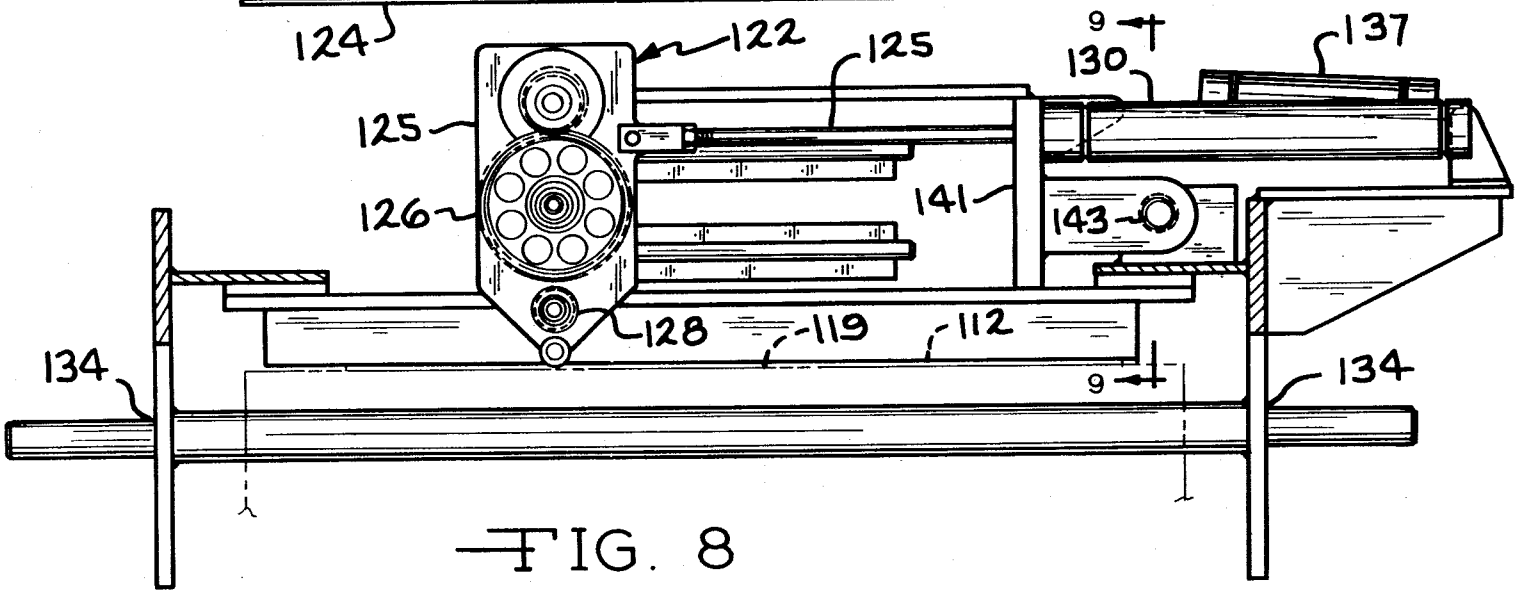
FIG. 8 is an elevational view taken along the line 8—8 of FIG. 7.

As best shown in FIGS. 1, 7 and 8, a tape and cutter head assembly 122 is pivotally mounted adjacent the vacuum table 119. The tape and cutter head assembly 122 is moved into and out of position adjacent the vacuum table 119 by cylinders 123. A serrated cutting knife 124 is mounted adjacent the outer end of the tape and cutter head assembly 122 and is used to cut the plastic film layer 112.

Referring to FIGS. 7 and 8, the tape and cutter head assembly 122 includes a tape head 125 having a main spool 126. The spool receives double-sided tape. An inert layer is removed and is wound on a waste spool 127. The tape passes a guide roller 128 and is discharged upon the plastic film layer 112 which is positioned on the vacuum table 119. A hold-down pad 129 retains the plastic film layer 112 against the vacuum table 119. The tape head 125 is moved along the plastic film layer 112 by a cylinder 130 having a rod 131 connected to the tape head 125.

The tape and cutter head assembly 122 is attached to the carriage 90 at a pivot connection 134. The cylinders 123 pivot the entire cutter and tape assembly head 122 around the pivot connection 134. Referring to FIGS. 8 and 9, a separate cylinder 137 is attached by a rod 138 and a bifercated fitting 139 to an arm 140 mounted on a tape head support plate 141. The plate 141 is pivotally connected at a pivot connection 143 to the framework for the tape and cutter assembly 122. The cylinder 137 is used to elevate the tape head 125 while the cylinder 130 is used as a stroking cylinder to reciprocate the tape head 125 along the width of the plastic film layer 112 as the two-sided tape is being applied.

Referring to FIGS. 1 and 8, the vacuum table 119 includes end plates 143 which are interconnected with the pivot arms 81 and 82 and which initially move with the pivot arms when the cylinders 81 are extended. The end plates 143 mount a roller 144 which is directly adjacent the plastic film layer 112. As the arms 81 and 82 are pivoted, after cutting of the plastic film layer and the adding of the adhesive layer, the cylinders 120 are extended. This rotates the end plates 143 and moves both the vacuum table 119 and the roller 144.

Figure 13:
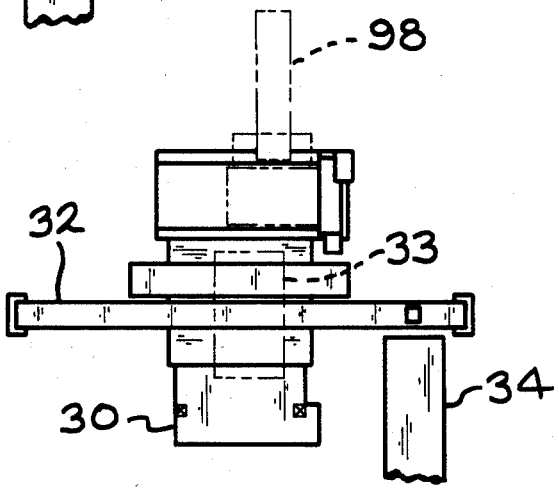
FIG. 13 is a diagramatic plan view similar to FIG. 11 showing a paper roll in a wrapping position.

FIGS. 12–28 diagramatically illustrate an operating cycle of the wrapping machine 30, according to the present invention. Initially a roll, such as the paper roll 33 is directed to the conveyor 32 by the feed conveyor 34 or by some other means. A sensor 147 having an audio sensing device 148 determines the diameter of the roll 33. The sensed diameter is sent to the control unit (not shown) where the microprocessor computes the length of film layer, foam layer or other material which is required to place the desired number of wraps or layers on the paper roll 33. It should be understood that various types of wrapping materials may be utilized and that various numbers of layers may be applied to the paper roll 33. After the operator inputs the desired numbers of layers, the paper roll 33 is moved along the conveyor 32 to the operating position shown in FIG. 13.

Figure 14:
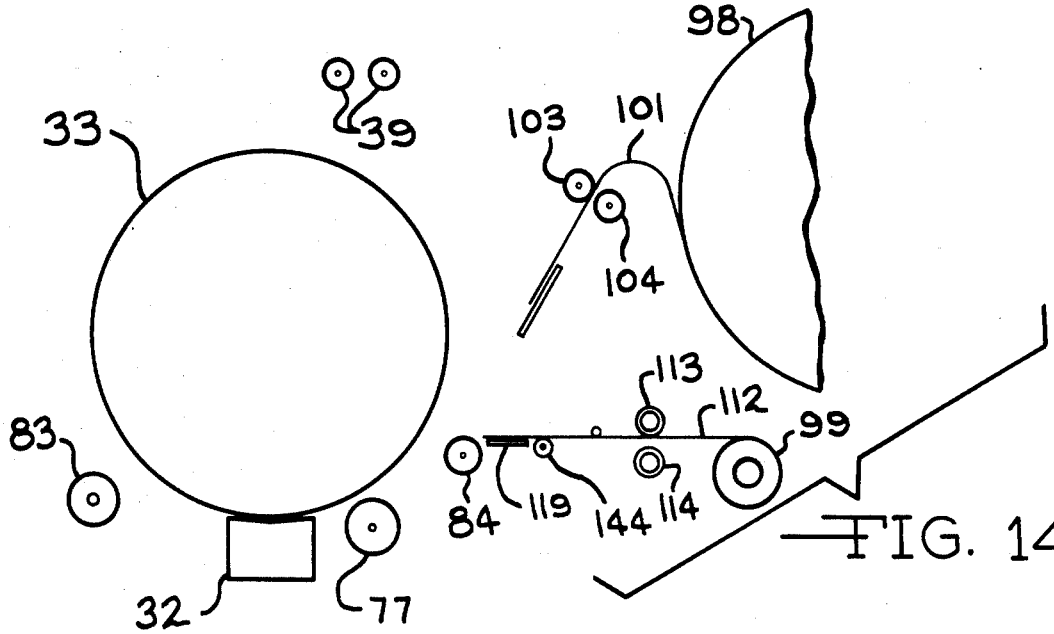
FIG. 14 is an enlarged diagramatic sectional view of the paper roll being wrapped and individual features of the wrap machine at a point in time when the roll is in the same position as shown in FIG. 13.
Figures 15, 16, 17:
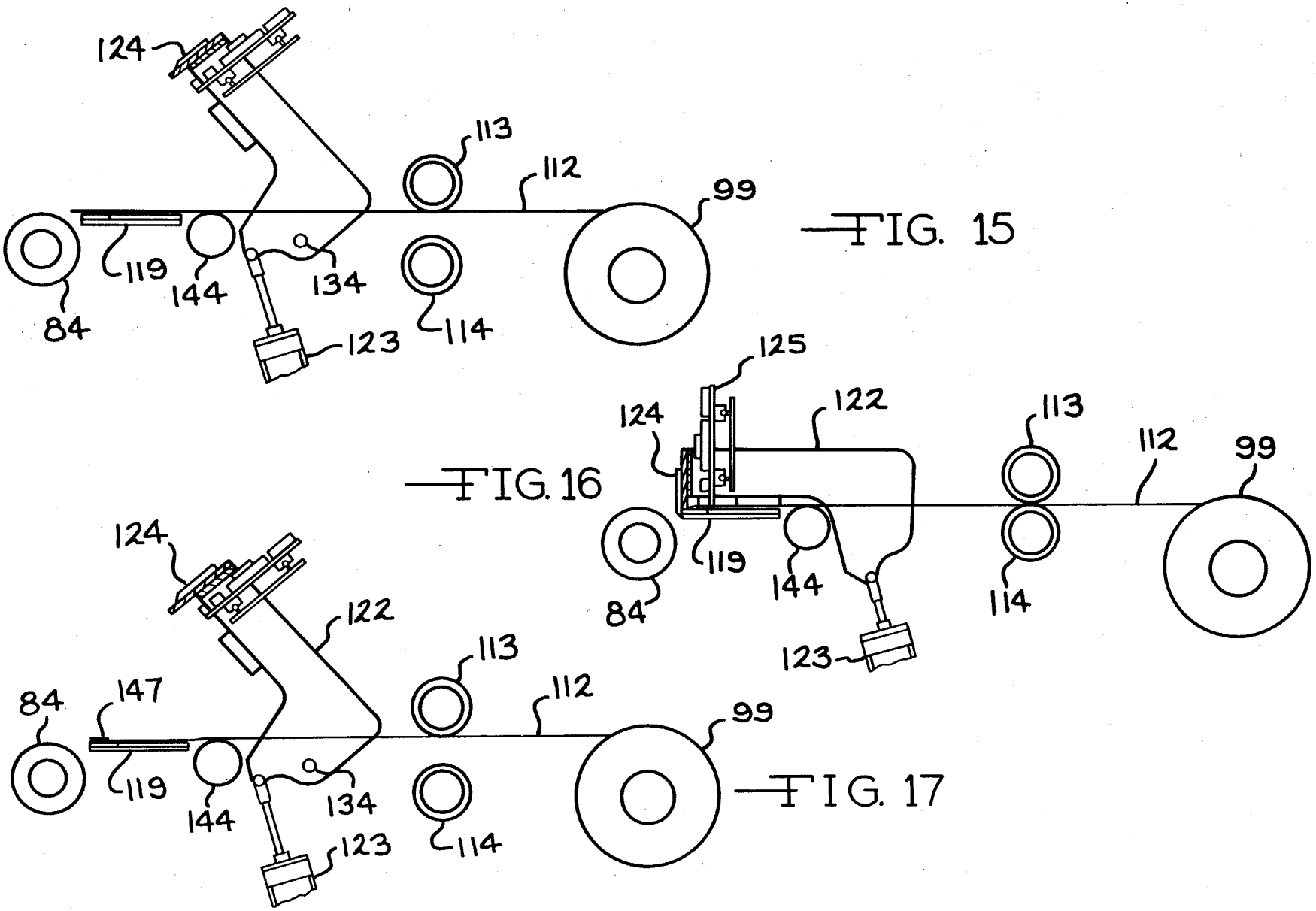
FIG. 15 is an enlarged view showing the initial plastic film layer on the vacuum frame table and showing the cutter mechanism raised above the plastic film layer.
FIG. 16 shows the plastic film layer as it is being cut.
FIG. 17 shows the cutting mechanism raised and showing a tape layer applied to the plastic film.

Referring to FIG. 14, during the initial operation the plastic film layer 112 is pulled into position over the vacuum table 119. Similarly, the foam material layer 101 is fed downwardly between the foam rollers 103 and 104. At this period of time, the paper roll 33 is still resting on the conveyor 32 and the hold-down rollers 39 are spaced above the paper roll 33. This initial condition is shown in enlarged scale in FIG. 15. At this time, as shown in FIG. 16, the serrated cutter knife 124 is moved downwardly to cut the outermost edge of the plastic film layer 112. The tape head 125 is actuated and a layer of tape 147 is adhered adjacent the cut edge of the plastic film layer 112.

Figure 18:
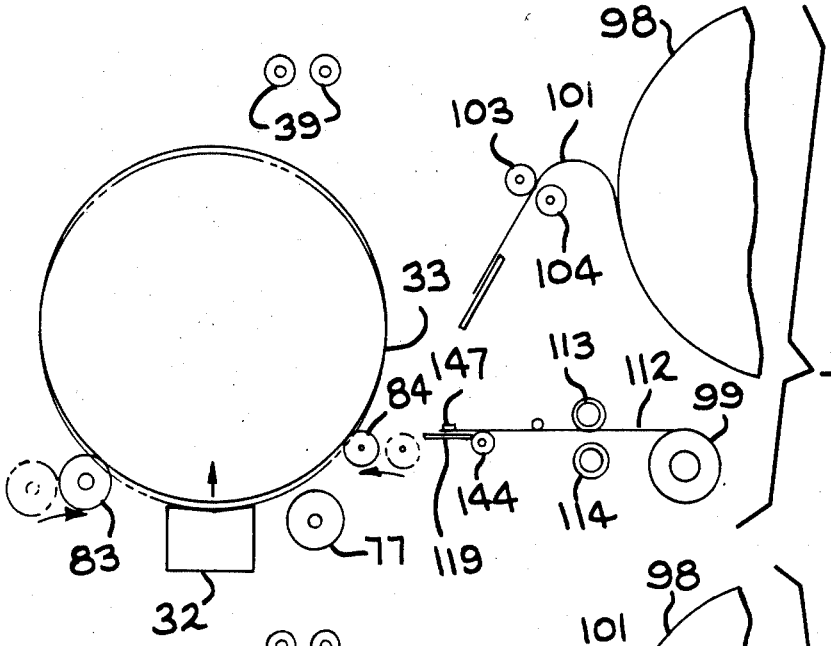
FIG. 18 is a view similar to FIG. 14 showing the paper roll on the conveyor.
Figure 19:
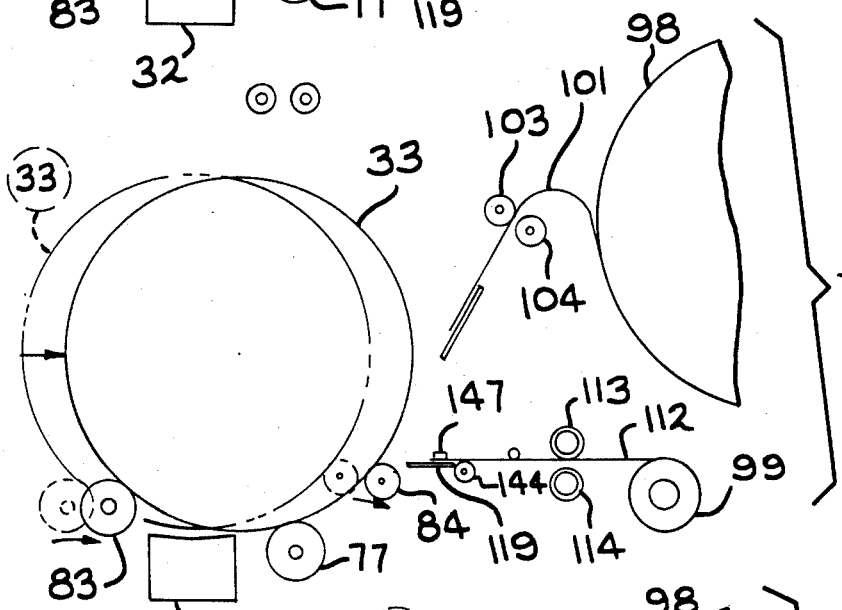
FIG. 19 is a view similar to FIG. 18 showing the paper roll as it is spaced from the conveyor.

Referring to FIG. 18, after the application of the tape layer 147 the rollers 83 and the 84 are moved inwardly from their dashed lines position and elevate the paper roll 33 from the conveyor 32. Continued movement of the roller 83 overrides the roller 84 and the paper roll 33 is moved to the right against the driven support roller 77. The rollers 83, 77 and 84 now support the paper roll 33 with a "three point" suspension.

Referring to FIG. 20, the hold-down rollers 39 mounted by the top frame assembly 37 are moved downwardly against the paper roll 33 as indicated by the solid line positions.

The vacuum table 119 has been rotated toward the paper roll 33 during the movement of the support roller 84 and actuation of the cylinders 120 rotate the vacuum table 119 to the position shown in FIG. 21. This adheres the tape layer 47 on the plastic film 117 to the outer periphery of the paper roll 33 having an outer layer of paper 150. As the driven support roller 77 rotates the paper roll 33, a layer of plastic film 112 is applied to the outer periphery of the paper roll 33. At approximately this point in time, the pads 68 shown in FIG. 4 having the sensors 69 move inwardly to sense the width of the paper roll 33 to determine any amount of reciprocation of the carriage 90 which might be needed.

Figure 22:
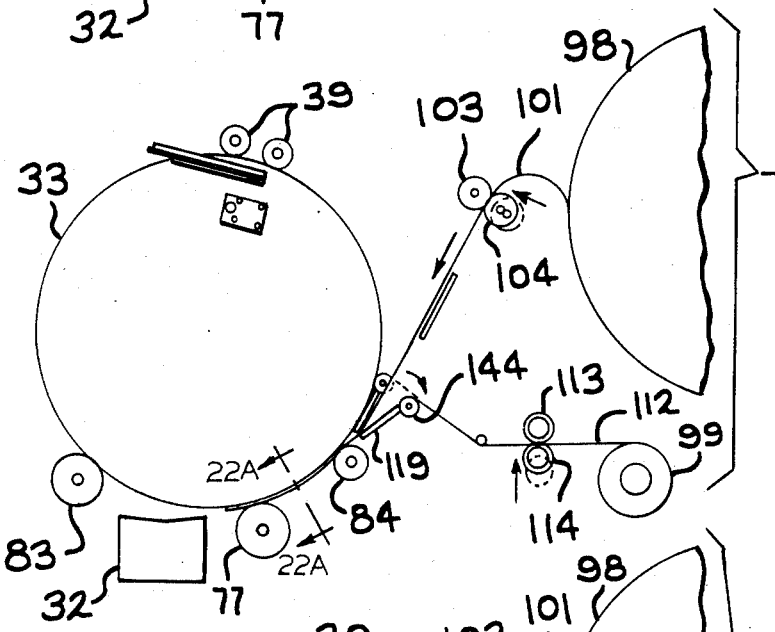
FIG. 22 show the paper roll after the initial plastic film layer is applied and as the initial foam layer is being introduced at the paper roll.
Figure 22A:
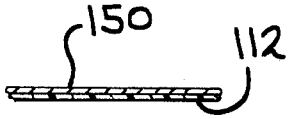
FIG. 22(A) is a cross-section showing a paper layer and the initial plastic film layer.
Figure 23:
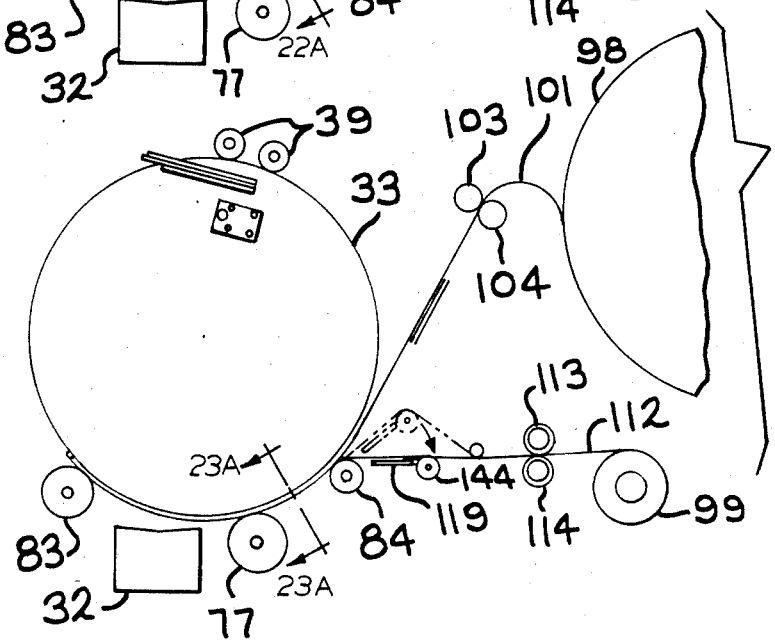
FIG. 23 shows the paper roll as the plastic film and foam material layers are being applied.
Figure 23A:
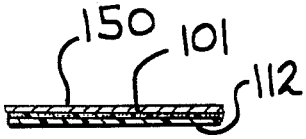
FIG. 23(A) shows a cross-section including a layer of paper; a layer of foam material and a layer of plastic film material.

Referring to FIG. 22, as rotation of the paper roll 33 begins, the vacuum frame 119 is moved partially back to form a nip for the foam layer 101. At the same time, the foam pressure roller 104 and the plastic film pressure roller 114 are moved into position adjacent the drive rollers 103 and 113. The foam layer 101 enters the nip and is sandwiched between the plastic film layer 112 and the paper layer 150 as shown in FIG. 23 A. As shown in FIG. 23, the vacuum table 119 continues to rotate toward its horizontal position along with the roller 144.

In the preferred method, according to the present invention, the layers are driven at various film speeds. For example, the driven support roller 77 drives the outer periphery of the paper roll 33 at a speed of 100 feet per minute. The foam drive roller 103 drives the foam layer at a rate of 90 feet per minute while the upper plastic film drive roller 113 drives the plastic film layer at a rate of 80 feet per minute. It has been found that these relative velocities impart the desired degree of stretch to the film layer 112 and the foam layer 101 as they form the protective "sandwich" over the periphery of the paper roll 33. After wrapping is completed, the cutter knives 108 and 123 sever the foam layer 101 and plastic film layer 112.

Figure 24:
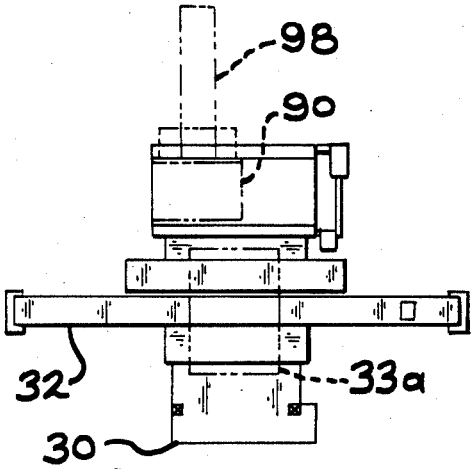
FIG. 24 is a diagramatic plan view similar to FIG. 11 and showing the carriage reciprocated to the opposite end of the machine base.
Figure 25:
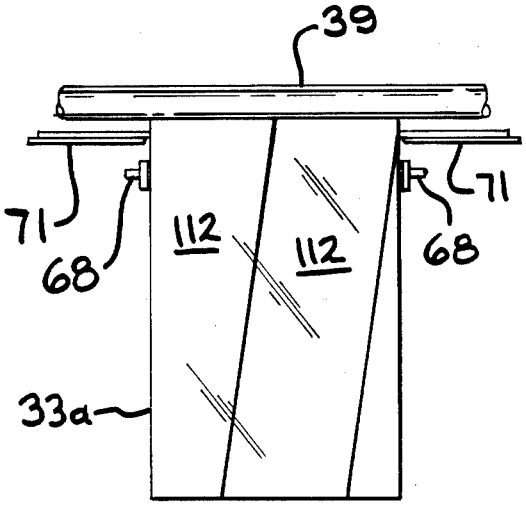
FIG. 25 is a diagramatic view showing wrapping by the use of the reciprocated carriage for wide paper rolls.

FIGS. 24 and 25 illustrate diagramatically the wrapping of a large roll 33*a*. In this situation, the wrapped material including the foam roll 98 is moved along with the carriage 90 as it is reciprocated. This applies the film layers across the entire width of the paper roll 33*a* as indicated in FIG. 25. Upon completion of wrapping, the upper tape heads 71, shown in FIGS. 4, 10 and 25, are moved against the sides of the paper roll 33*a* to place an adhesive tape layer 154 on the sides of the paper rolls 33, as indicated in FIG. 26. The tape layer 154 is used to place the protective members 155 on the ends.

Figure 27:
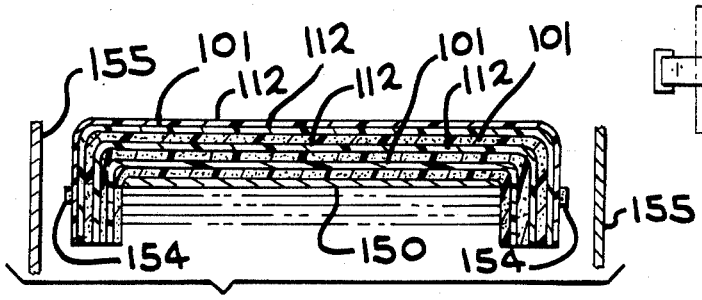
FIG. 27 is an enlarged cross-sectional view showing multiple layers of wrapping materials and showing the side adhesive layers.

FIG. 27 indicates that a plurality of plastic film layers 112 and foam layers 101 may be placed over the outer paper layer 150 of the paper roll 33*a*.

Figure 28:
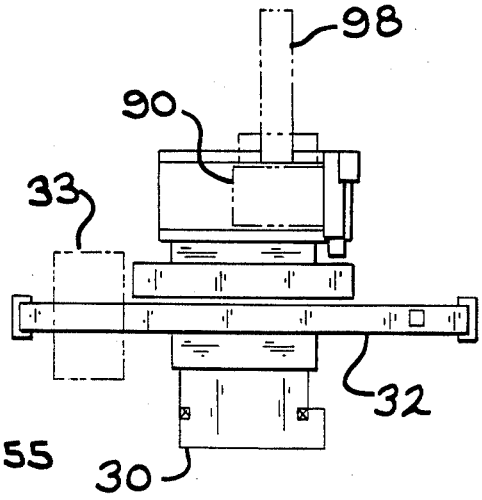
FIG. 28 is a diagramatic plan view similar to FIG. 11 showing the completed wrapped paper roll in the exit position and showing the carriage reciprocated to the home position ready for the next operation.

Lastly, the paper roll 33 or 33*a* is moved from the exit end of the conveyor 32 and the carriage 90 reciprocated back to the home position as shown in Fig. 28 awaiting the next paper roll 33 to be wrapped.

Numerous modifications may be made to the preferred embodiment of the wrapping machine 30 shown and described herein and still fall within the following claims.

I claim:

1. A wrapping machine for wrapping a roll comprising, in combination, conveyor means for receiving a roll to be wrapped, support and drive means for spacing such roll from the conveyor means and rotating such roll about its axis of rotation.

hold-down means for supporting the upper portion of such roll, carriage means adjacent such roll for supporting at least one wrap material, said carriage means being reciprocable along a path parallel to the axis of rotation of such roll, supply means on said carriage means for delivering such wrap material to such roll, a vacuum table mounted adjacent such roll to be wrapped for receiving and holding a layer of wrap material, taping means adjacent said wrap material for applying an adhesive tape to said wrap material held on said vacuum table, and means for moving said vacuum table to such roll to be wrapped to adhere the held tape and layer of wrap material to such roll.

2. A wrapping machine according to claim 1, wherein said support and drive means includes a pair of longitudinally extending rollers positioned on opposed sides of said conveyor means, each of said rollers being mounted on pivotal arms and cylinder means for pivoting said arms whereby each of said rollers is moved toward and away from such roll.

3. A wrapping machine according to claim 1, wherein said support and drive means includes a longitudinally extending drive roller mounted adjacent said conveyor, said roll being engageable with said drive roller whereby said drive roller rotates such roll about its axis of rotation and a drive motor operatively connected to said drive roller.

4. A wrapping machine according to claim 1, wherein said hold-down means includes a pair of vertically movable top rollers positioned above such roll.

5. A wrapping machine according to claim 4, wherein said hold-down means includes a vertical frame mounted adjacent said conveyor, a top frame assembly mounted for vertical movement along said vertical frame, said top frame mounting said pair of top rollers.

6. A wrapping machine according to claim 5, including sensing means mounted adjacent said top frame for sensing the height of such roll.

7. A wrapping machine according to claim 5, wherein said vertical frame includes spaced apart vertical members having vertical racks mounted adjacent each member, said top frame assembly being mounted for vertical movement between said spaced apart vertical members, a gear mounted on each side of said top frame assembly for engagement with a respective vertical rack and drive means for vertically moving said top frame assembly relative to said vertical frame.

8. A wrapping machine according to claim 7, wherein said drive means includes a drive cylinder and a drive chain operatively connected between said vertical frame and said top frame assembly.

9. A wrapping machine according to claim 1, wherein said carriage means supports at least two wrap materials comprising a foam wrap material and a plastic film wrap material, said carriage means including drive means for moving said foam wrap material and said plastic film material along paths to such roll and cutting means for cutting said foam wrap material and said plastic film material.

10. A wrapping machine according to claim 9, wherein said carriage means includes a generally rectangular carriage frame, a threaded drive shaft extending parallel to such axis of rotation, motor means for rotating said threaded drive shaft, said rectangular carriage frame being mounted for movement on said threaded drive shaft.

11. A wrapping machine for wrapping a roll comprising, in combination, support and drive means for supporting such roll and for rotating such roll about its axis of rotation, hold-down means for supporting the upper portion of such roll, carriage means adjacent such roll for supporting at least one wrap material, said carriage means being reciprocable along a path parallel to the axis of rotation of such roll, vacuum hold-down means mounted adjacent such roll to be wrapped for receiving and holding a layer of wrap material, taping means adjacent said wrap material for applying an adhesive tape to said wrap material held on said vacuum hold-down means; and means for moving said vacuum hold-down means to such roll to be wrapped to apply the held tape and layer of wrap material to such roll.

12. A wrapping machine according to claim 11, wherein said hold-down means includes a vertically movable top frame assembly, at least two rollers mounted by said top frame and positioned above said support and drive means and opposed pads mounted adjacent said top frame for movement toward one another and toward an individual paper roll which is to be wrapped.

13. A wrapping machine according to claim 11, wherein said support and drive means includes a pair of longitudinally extending rollers, each of said rollers being mounted on pivotal arms and cylinder means for pivoting said arms, whereby each of said rollers is moved toward and away from such roll.

14. A wrapping machine according to claim 11, wherein said support and drive means includes a longitudinally extending drive roller, such roll being engageable with said drive roller, whereby said drive roller rotates such roll about its axis of rotation and a drive motor operatively connected to said drive roller.

15. A wrapping machine according to claim 11, wherein said hold-down means includes a pair of vertically movable top rollers positioned above such roll.

16. A wrapping machine according to claim 11, wherein said carriage means supports at least two wrap materials comprising a foam wrap material and a plastic film wrap material, said carriage means including drive means for moving said foam wrap material and said plastic film material along paths to such roll and cutting means for cutting said foam wrap material and said plastic film material.

17. A wrapping machine according to claim 11, wherein said carriage means includes a generally rectangular carriage frame, a threaded drive shaft extending parallel to such axis of rotation, motor means for rotating said threaded drive shaft, said rectangular carriage frame being mounted for movement on said threaded drive shaft.

* * * * *